US007086189B2

(12) United States Patent
Morris et al.

(10) Patent No.: US 7,086,189 B2
(45) Date of Patent: Aug. 8, 2006

(54) REMOVABLE DECORATIVE BASKETBALL BACKBOARD SIGNBOARD

(76) Inventors: James M. Morris, 18785 Titan Pl., Castro Valley, CA (US) 94546; Gail M. Morris, 18785 Titan Pl., Castro Valley, CA (US) 94546

( * ) Notice: Subject to any disclaimer, the term of this patent is extended or adjusted under 35 U.S.C. 154(b) by 0 days.

(21) Appl. No.: 10/454,176

(22) Filed: Jun. 4, 2003

(65) Prior Publication Data

US 2004/0035035 A1 Feb. 26, 2004

Related U.S. Application Data

(60) Provisional application No. 60/387,044, filed on Jun. 7, 2002.

(51) Int. Cl.
*G09G 3/00* (2006.01)
*A73B 63/00* (2006.01)

(52) U.S. Cl. ..... 40/606.03; 40/299.01; 473/476; 473/481; 473/504

(58) Field of Classification Search ..... 40/538, 40/539, 611.01, 299.01; 473/476, 481, 504
See application file for complete search history.

(56) References Cited

U.S. PATENT DOCUMENTS 4,763,947 A * 8/1988 Gregg ..... 160/370.23
5,195,742 A 3/1993 Bailey ..... 273/1.5 R
5,467,545 A * 11/1995 Zillner ..... 40/597
5,485,694 A 1/1996 Goad ..... 40/661
5,570,735 A * 11/1996 Chu ..... 160/370.23
D423,615 S 4/2000 Wiedner et al. ..... D21/701
D423,616 S 4/2000 Wiedner et al. ..... D21/701
D425,587 S 5/2000 Wiedner ..... D21/701
6,135,193 A * 10/2000 Lloyd ..... 160/370.23
D434,091 S 11/2000 Wiedner ..... D21/701
D434,092 S 11/2000 Wiedner ..... D21/701
6,196,938 B1 3/2001 Wiedner ..... 473/476
D447,195 S 8/2001 Wiedner et al. ..... D21/701
6,308,447 B1 * 10/2001 Tress ..... 40/607.03

* cited by examiner

*Primary Examiner*—Cassandra Davis
(74) *Attorney, Agent, or Firm*—Henneman & Saunders; Larry E. Henneman, Jr.

(57) ABSTRACT

A sign for display on a basketball backboard includes a substantially rigid sheet of material having indicia to be displayed on a front surface thereof. The sheet of material includes a notch formed in a lower edge of the sheet of material for engaging rim. When the sign is mounted on the backboard with the rim disposed in the notch, one or more attachment devices secure the sheet to the backboard. Various attachment devices including straps, hooks, and elastic cords are disclosed. At least some of the attachment devices are reversible, such that either side of the sign can be displayed.

37 Claims, 9 Drawing Sheets

REMOVABLE DECORATIVE BASKETBALL BACKBOARD SIGNBOARD

RELATED APPLICATIONS

This application claims the right of priority to U.S. Provisional Patent Application Ser. No. 60/387,044, which was filed by the same inventors on Jun. 7, 2002, and is incorporated herein by reference in its entirety.

BACKGROUND

1. Field of Invention

This invention relates to the field of signage. More specifically, this invention relates to a signage display system including a removable decorative signboard that is adapted to be secured to a basketball backboard for the purpose of displaying advertising, promotional material or other indicia.

2. Related Art

Signage is a broad category encompassing a multitude of designs and methods for displaying advertising, decorations or other indicia.

To display indicia at an elevated height at a typical house, business, or school, one needs to hang the display on a building, wall or other elevated device (i.e. flag poles). It would be desirable to use an existing device to perform this kind of elevated signage, such as a basketball backboard. Basketball backboards are typically mounted on a pole, house, or garage and are used to play the game of basketball. It would be desirable if a removable decorative signage device were provided that would utilize the basketball backboard as an advertising display mechanism.

To provide signage on basketball backboards, one typically needs to paint or permanently affix the signage materials permanently on the backboard. This method of signage has its disadvantages as it limits the backboard to one display, unless repainted or replaced. Repainting and replacing backboards is not practical, can damage the backboard, and is most likely, cost prohibitive.

It would be desirable if a device were provided that would provide a means of signage on a basketball backboard that could be quickly removed without altering or damaging the basketball backboard. Removable signage on a basketball backboard enables the display of unlimited indicia, including holiday themes, decorative displays, sports team insignias or logos, birthdays, anniversaries or other special events. The number and types of signage themes are virtually limitless.

In addition, it would be desirable if a single device were provided that could attach to any size or shape basketball backboard (i.e. rectangular, fan-shaped, or other) and provide signage that was not limited to the general size or dimensions of the backboard, thereby allowing the signage to be highly visible and prominent, and whose shape could be customized depending on the signage theme. Further, it would be desirable if a single device could provide signage on both the front face and back face of the signboard, doubling the type of signage that could be provided from one signboard.

Throughout the years, a number of innovations have been developed relating to signage and signage/poster systems and the following U.S. patents are representative of some of those innovations: U.S. Pat. Nos. 4,523,400; 4,936,033; 4,976,055; 5,090,143, and 5,485,694. For example, U.S. Pat. No. 5,485,694, a Door-Mounted Poster Support, allows various size posters to be displayed on a door. However, application for use on a basketball backboard is questionable. Concerns for use of this device on a basketball backboard include probable damage to posters from adverse weather conditions, and questionable fit over the different dimensions of the various size and shape backboards. Further, the bulky nature of the poster support would not be conducive to easy storage or transport when removed from the basketball backboard. It would be desirable if a single device were provided that could display indicia on a basketball backboard that was both weather resistant and could fit any size or shape backboard. Additionally, it would be desirable if a device were provided that could display indicia on a basketball backboard and was capable of being folded when not in use allowing it to be easily stored and transported.

There have also been a number of innovations relating to motor vehicle sunshields and poster systems, and the following U.S. patents are representative of some of those innovations: U.S. Pat. Nos. 4,202,396; 4,805,955, and 5,046,543. For example, U.S. Pat. No. 5,046,543, a Motor Vehicle Sunshield and Poster System, provides motor vehicle shading as well as a poster-like message publicly displayable through a motor vehicle window. The device is also publicly displayable outdoors apart from the motor vehicle by a person holding the sunshield up in the air via lateral handles. However, application for use on a basketball backboard is questionable. Concerns for use of this cardboard-like material on a basketball backboard include probable damage and deterioration from adverse weather conditions, and a lack of attachment mechanism for attaching to the basketball backboard. It would be desirable if a device were provided that could display indicia on a basketball backboard that was both weather resistant and had an attachment mechanism for attaching or securing the device to any size or shape backboard.

Innovations relating to removable signage or signage systems specific to basketball backboards appear limited to backboard covers, and the following U.S. patents are representative of some of those innovations. U.S. Pat. Nos. Des. 398, 346; Des. 398,347; Des. 400,607; Des. 402,346; Des. 404,096; Des. 423,615; Des. 423,616; Des. 425,587; Des. 434,091; Des. 434,092; Des. 447,195, and 6,196,938. All of these innovations are basketball backboard covers. For example, U.S. Pat. No. 6,196,938 is a removable basketball backboard cover adapted to fit on a basketball backboard. The central portion of the cover extends across the front face of the basketball backboard and the leading edge portion of the cover is adapted to extend across a portion of the back face of the backboard. The central portion of the removable cover preferably displays advertising or other promotional material. Unfortunately, with the leading edge portion extending across a portion of the back face of the backboard, the size of the display of advertising or other promotional material is limited to the general dimensions of the basketball backboard. In addition, a cover does not allow for the shape of the signage to be customized depending on the signage theme (e.g., shaped like a pumpkin for a Halloween signage theme, etc.). Further, a change in the shape of the backboard (e.g., rectangular shaped to a fan-shaped etc.) would require a new cover to match the shape. It would be desirable if a single device were provided that could attach or be secured to any size or shape basketball backboard (e.g., rectangular, fan-shaped, other) and whose leading edge is not designed to extend across a portion of the back face of the backboard and does not, thereby limit the size of the signage to the general dimensions of the basketball backboard. Rather, the shape of the device could be customized depending on the signage theme.

While the foregoing prior art indicates numerous signage schemes, the prior art described above does not suggest a removable decorative backboard signboard for basketball backboards which combines two or more of the following desirable features: (1) device is weather resistant; (2) a single device fits any size or shape basketball backboard; (3) device made from substantially rigid material whose leading edge does not have to extend across a portion of the back face of the backboard and thereby does not limit the size of the signage to the general dimensions of the basketball backboard, enabling the signage to be highly visible and prominent, and whose shape can be customized depending on the signage theme; (4) a single device with an attachment or securing mechanism adaptable to fit any size basketball backboard; (5) a single device capable of having signage on both the front face and back face of the signboard, doubling the type of signage that could be provided from one signboard; (6) device is capable of being folded, depending on substantially rigid material used; (7) the device may include complementary decorative matter adapted for attachment to the basketball rim. The foregoing desired characteristics are provided by the unique removable decorative backboard signboard of the present invention as will be made apparent from the following description thereof. Other advantages of the present invention over the prior art also will be rendered evident.

SUMMARY

To achieve the foregoing and other advantages, the present invention, briefly described, provides a new and improved removable decorative basketball backboard signboard, which includes a weather resistant, rectangular or custom shaped, substantially rigid sheet material, adapted to fit on any size or shape basketball backboard. The substantially rigid sheet material comprises a rectangular or custom shaped front face with dimensions beyond the dimensions of the backboard itself, and displays indicia including, but not limited to, advertisements, holiday themes, decorative displays, sports team insignias or logos, birthdays, anniversaries or other special events. Indicia can be displayed on both the front face and back face of the signboard. The bottom central portion of the signboard has a rectangular opening adapted to permit a rim attached to the front face of the basketball backboard to project through. In one embodiment, the opening is sized to allow the bottom central portion of the signboard to rest or anchor itself on the rim deep enough so the leading (top, bottom and side) edges of the rectangular or custom shaped substantially rigid sheet material extend beyond the dimensions of the basketball backboard. Once anchored onto the rim, the signboard is then attached or secured to the basketball backboard via one of several attachment/securing schemes, including, but not limited to, flat hooks, rope/elastic cord material, or straps connected from the back of the device to the basketball backboard. Thus, the weather resistant, removable decorative signboard of the present invention lends itself to displaying indicia on both the front and back face of the signboard, can fit on any size or shape backboard using a single device, whose leading edges need not extend across the back face of the backboard, and therefore easily extends beyond the dimensions of backboard, allowing the signage to be highly visible and prominent, and whose shape can be customized depending on the signage theme. The signboard system may include complementary decorative matter adapted for attachment to the basketball backboard rim.

Optionally, the signboard would utilize a substantially rigid sheet material having preformed folds and/or cuts therein to facilitate folding for storage and transportation of the device when removed from the basketball backboard.

As yet another option, the signboard can include complementary decorative matter attached to the basketball rim.

The above-described and other objects and advantages of the present invention will become clear to those skilled in the art in view of this disclosure. The desirable features and advantages listed or discussed herein are not an exhaustive list of all possible features or advantages of the invention. Moreover, it will be possible to practice the invention even where one or more of the intended features and/or advantages might be absent or not required in the application.

Further, those skilled in the art will recognize that various embodiments of the present invention may include one or more, but not necessarily all, of the above-described desirable features and/or advantages. Accordingly, the listed features and advantages are not essential elements of the present invention, and should not be construed as limitations.

BRIEF DESCRIPTION OF THE DRAWINGS

The present invention is described with reference to the following drawings, wherein like reference numbers denote substantially similar elements.

DETAILED DESCRIPTION

Figure 1:
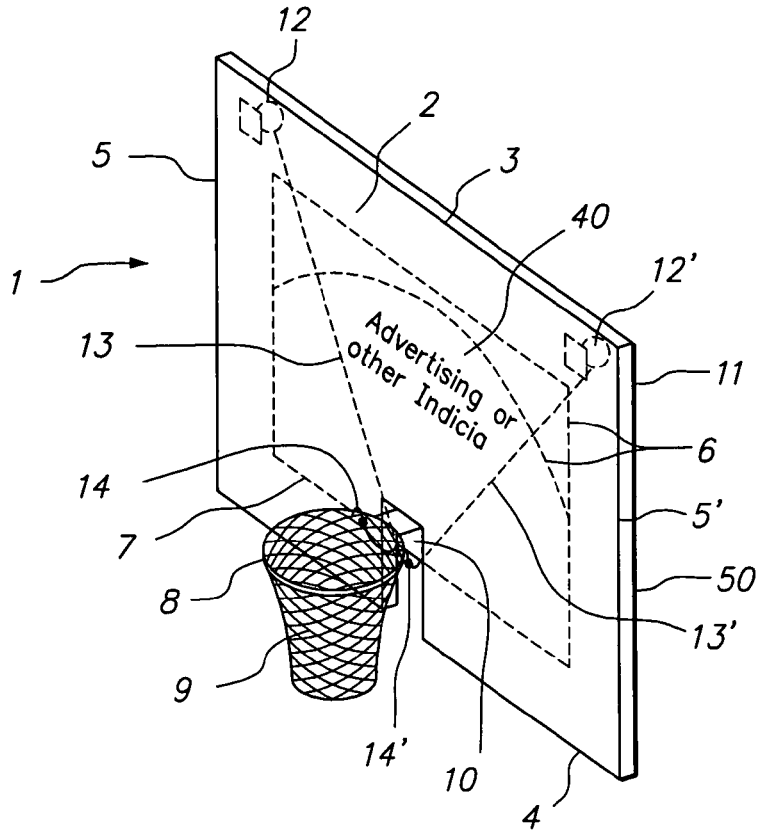
FIG. 1 is a perspective front view of one embodiment of a removable decorative backboard signboard attached/secured to a basketball backboard.

Referring to FIG. 1, a removable, decorative backboard signboard 1 is rectangular or custom shaped, made from a weather resistant, substantially rigid sheet material, with a front face 2, a back face 50, a top 3, a bottom 4, and sides 5 and 5'. The dimensions of the rectangular or custom shaped weather resistant, substantially rigid sheet material exceeds the dimensions of the basketball backboard. Both a rectangular basketball backboard and fan-shaped basketball backboard 6 are shown in dashed lines to illustrate how a single removable decorative backboard signboard 1 fits both. A rim 8 is attached to, and projects from backboard 6. A net 9 hangs from the rim 8. The bottom portion 4 of the removable decorative signboard 1 has a center rectangular opening 10 adapted to permit the removable decorative backboard signboard 1 to anchor onto the rim 8. The opening 10 is sized so the signboard 1 rests or anchors itself on the rim 8 deep enough to allow the front face 2, top 3, bottom 4, and sides 5 and 5' of the signboard 1 to extend beyond the dimensions of the backboard 6, thereby, allowing the signage to be highly visible and prominent. The front face 2 of the signboard 1 will display indicia 40, including, but not limited to, holiday themes, decorative displays, sports team insignias or logos, birthdays, anniversaries or other special events. The top portion 11 of the back face 50 of signboard 1 has two adhesive mounted loops 12 and 12' attached. Attached to the loops 12 and 12' are elastic or BUNGY type cords 13 and 13' which wrap under the bottom 7 of backboard 6, through the center rectangular opening 10 of signboard 1, and attach to the rim 8 via hooks 14 and 14' located on the other ends of cords 13 and 13', thus securing signboard 1 to backboard 6. The signboard 1 can provide signage on both the front face 2 and back face 50. To display indicia on the back face 50, the above attachment scheme is applied the same way to the front face 2.

Figure 2:
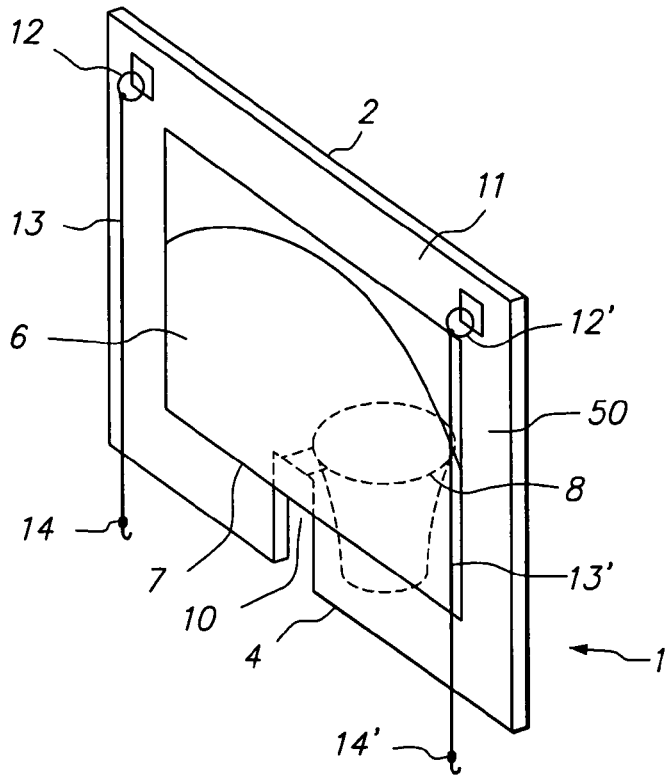
FIG. 2 is a perspective back view of the removable decorative backboard signboard attached/secured to a basketball backboard illustrated in FIG. 1.

As illustrated in FIG. 2, in this particular embodiment of the invention, the top portion 11 of the back face 50 of the signboard 1 has two adhesive mounted loops 12 and 12' attached. Attached to loops 12 and 12', are elastic or BUNGY type cords 13 and 13' each having a hook or other similar fastener 14 and 14' located on the opposite end. These fastening ends 14 and 14' ultimately wrap under the bottom 7 of backboard 6, through the center rectangular opening 10 of signboard 1 and attach to the rim 8 securing signboard 1 to backboard 6. The signboard 1 can provide signage on both the front face 2 and back face 50. To display indicia on the back face 50, the above attachment scheme is applied the same way to the front face 2.

Figure 2A:
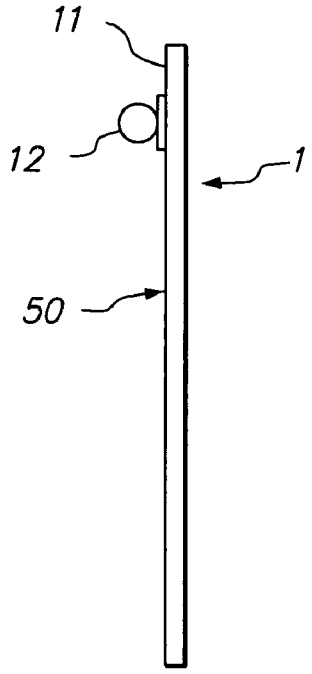
FIG. 2*a* is a side view of the fastening device attached to the removable decorative backboard signboard in FIG. 2.

FIG. 2*a* shows a side view of the signboard 1 and illustrates the adhesive mount loop 12 attached to the top portion 11 of the back face 50 of the signboard 1.

Figure 2B:
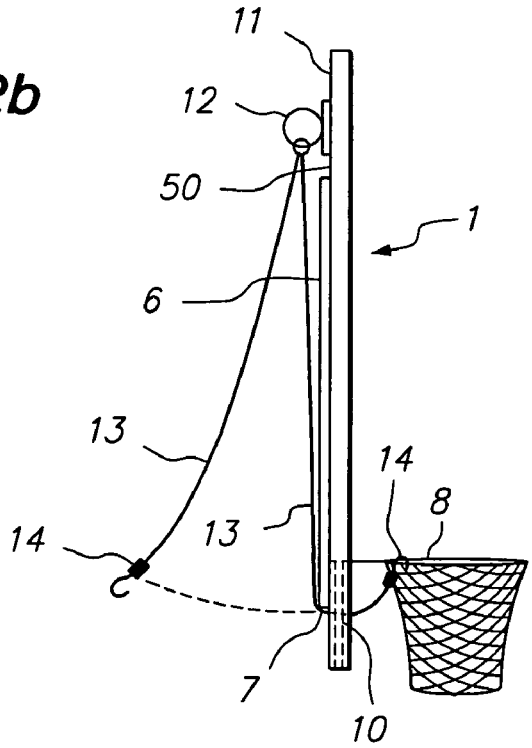
FIG. 2*b* is a side view of elastic cord material shown in FIG. 2, with one end of the material tied to the fastening device illustrated in FIG. 2*a* and a fastening device located on the other end of the material, projected to illustrate attachment to the rim.

FIG. 2*b* shows a side view of the signboard 1 and further illustrates the adhesive mount loop 12 attached to the top portion 11 of the back face 50 of the signboard 1. The elastic or BUNGY cord material 13 is tied to the adhesive mount loop 12, with a hook or similar fastener 14 located on the other end of cord 13 and is shown projected by dashed lines to wrap under the bottom 7 of backboard 6, through the center rectangular opening 10 of signboard 1, and attach to the rim 8, securing signboard 1 to backboard 6. Note that cords 13, 13' could optionally be attached to loops 12 by a hook or other device similar to fastener 14.

As those skilled in the art will appreciate, the embodiments shown herein can be modified without departing from the intended scope of the invention. For example, the present invention is not limited to any specific material, and a variety of weather resistant, substantially rigid sheet materials may be suitably used. Thus, signboard 1 can be made from any suitable weather resistant, substantially rigid sheet material including, but not limited to, wood, acrylics and corrugated plastic. Indeed, if signboard 1 is intended for use in a protected environment, the material need not even be weather resistant. Additionally, although signboard 1 is shown primarily rectangular in shape, the edges may be rounded or shaped to provide a more finished appearance, or the overall shape may be customized depending on the theme of the signage (e.g. shaped like a pumpkin for a Halloween signage or a heart for a Valentine signage theme, etc.). Further, although adhesive mount loops 12 and 12' are shown as an example, the adhesive loops can be replaced by adhesive hooks or other similar fasteners, and other suitable means could be used to attach the fasteners to signboard 1. As yet another example, rope or other suitable material can be substituted for the elastic/BUNGY cords shown in the example embodiment. In lieu of adhesive fasteners, holes or slits can be formed in signboard 10, through which cord or rope material can be passed and/or knotted so as to secure the rope or cord to signboard 10.

Figure 3:
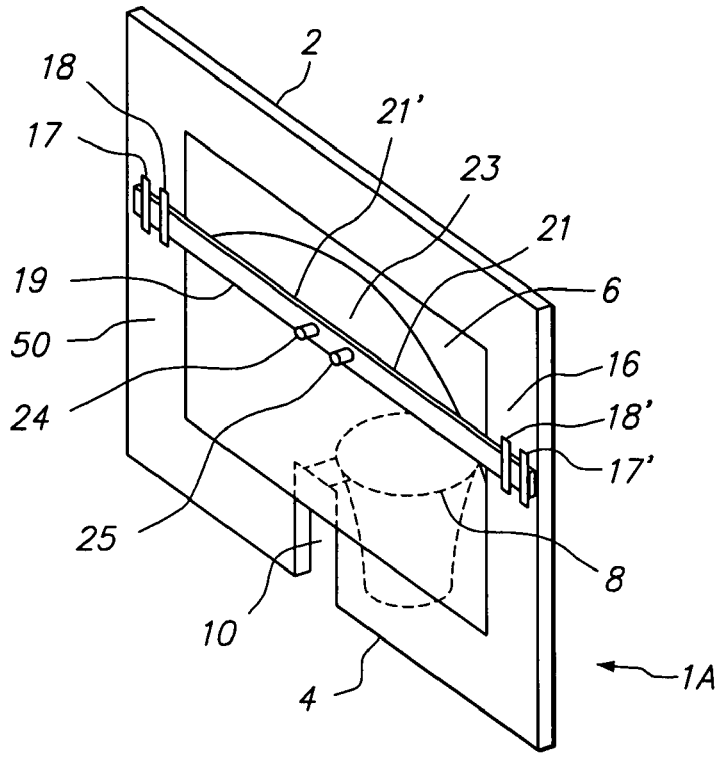
FIG. 3 is perspective back view of another embodiment of a removable decorative backboard signboard attached/secured to a basketball backboard with a strapping system.

FIG. 3 shows an alternate signboard 1A according to the present invention. In signboard 1A, a middle portion 16 of the back face 50 defines two pairs of parallel slots, an outer pair 17 and 17', and an inner pair 18 and 18', cut through the substantially rigid sheet material to accommodate attachment of a strap 19. Strap 19 is attached to signboard 1A as follows. First, one end 21 of strap 19 is from the back face 50 of signboard 1A, through outer slot 17, to the front side of signboard 1A. Then end 21 of strap 19 is passed back through the inner slot 18 and extended across the middle portion 16 of the back face 50 of signboard 1A. Next, end 21 of strap 19 is passed, from rear to front, through inner slot 18', and then back through the outer slot 17', from front to rear. Finally, end 21 of strap 19 is extended across the middle portion 16 of the back face 50 of signboard 1A. The two ends 21 and 21' of strap 19 now meet in the center 23 of the back face 50 of signboard 1A, where they can be connected by a buckle, hook-and loop fastener (e.g., VELCR®), or other means of attachment shown representationally as attachment devices 24 and 25. Optionally, the ends 21, 21' of strap 19 can simply be tied together. The bottom portion 4 of signboard 1A has a center rectangular opening 10 adapted to permit signboard 1A to rest on rim 8. Once signboard 1A is engaged with rim 8, signboard 1A is secured in place by wrapping ends 21 and 21' of strap 19 around backboard 6, and connecting them with attachment devices 24 and 25.

The signboard 1A can provide signage on both the front face 2 and back face 50. To display indicia on the back face 50, strap 19 is simply inserted through openings 17, 17', 18, 18' starting from the front side of signboard 1A, instead of from the rear as described above.

Figure 3A:
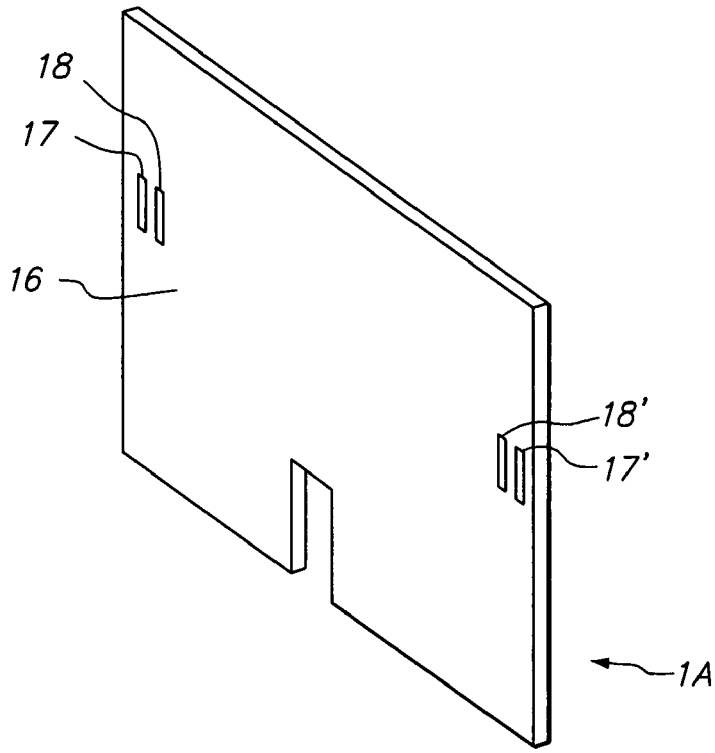
FIG. 3*a* is a front or back view of the removable decorative backboard signboard removed from the basketball backboard showing the shape and position of the slots on the center portion of the signboard to accommodate the strapping system in FIG. 3.

FIG. 3*a* shows signboard 1A removed from the basketball backboard (not shown), and illustrates the location and shape of the parallel inner slots 18 and 18' and outer slots 17 and 17'. The parallel inner slots 18 and 18' and outer slots 17 and 17' are cut through the substantially rigid sheet material at a point (middle portion 16 in this example) such that strap 19 (FIG. 3) will engage backboard 6, when opening 10 is resting on rim 8.

Figure 3B:
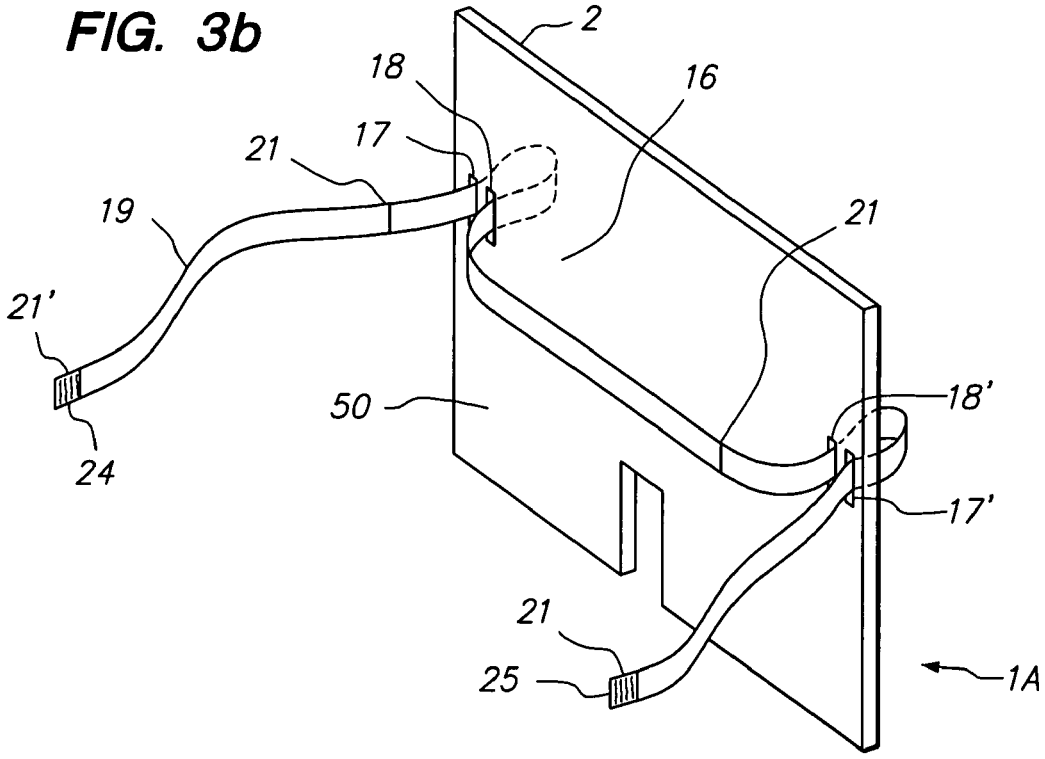
FIG. 3*b* is a back view of the removable decorative backboard signboard removed from the basketball backboard illustrating the sequence required to attach the strap to the signboard prior to using it to secure the signboard to the backboard in FIG. 3.

FIG. 3*b* shows the signboard 1A with strap 19 passing loosely through slots 17, 17', 18, and 18' to illustrate more clearly the path of strap 19 when displaying front surface 2 of signboard 1A.

Figure 3C:
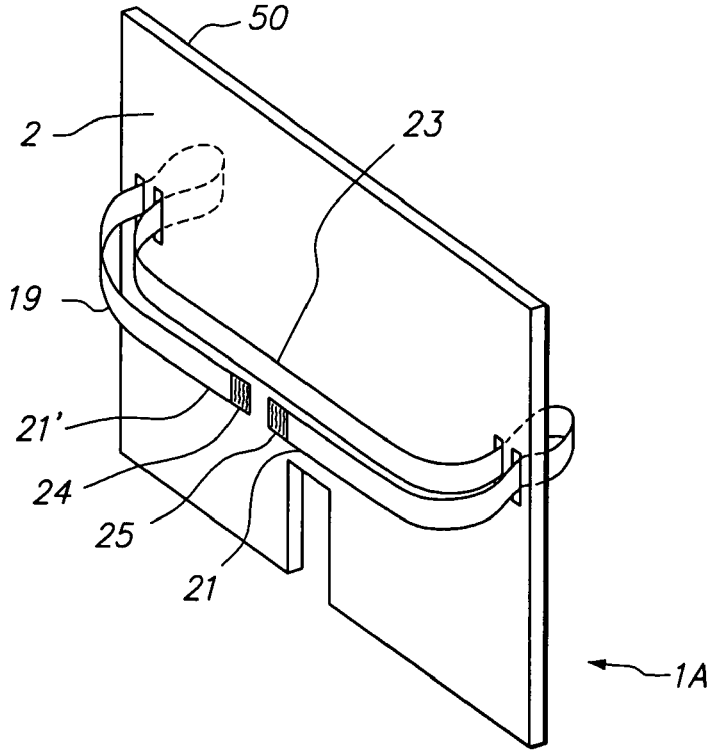
FIG. 3*c* is a back view of the removable decorative backboard signboard removed from the basketball backboard illustrating the end result of the strap attachment sequence described in FIG. 3*b;*

FIG. 3*c* shows the signboard 1A with strap 19 passing loosely through slots 17, 17', 18, and 18' to illustrate more clearly the path of strap 19 when displaying back surface 50 of signboard 1A.

In an alternate embodiment (not shown), only one slot is proved on each side of the signboard. Two straps are used in this alternate embodiment, one passing through each slot. Each strap includes a fastening device on one end, and a retaining device on the other end. The retaining device prevents the strap from pulling all the way through the slot.

Figure 4:
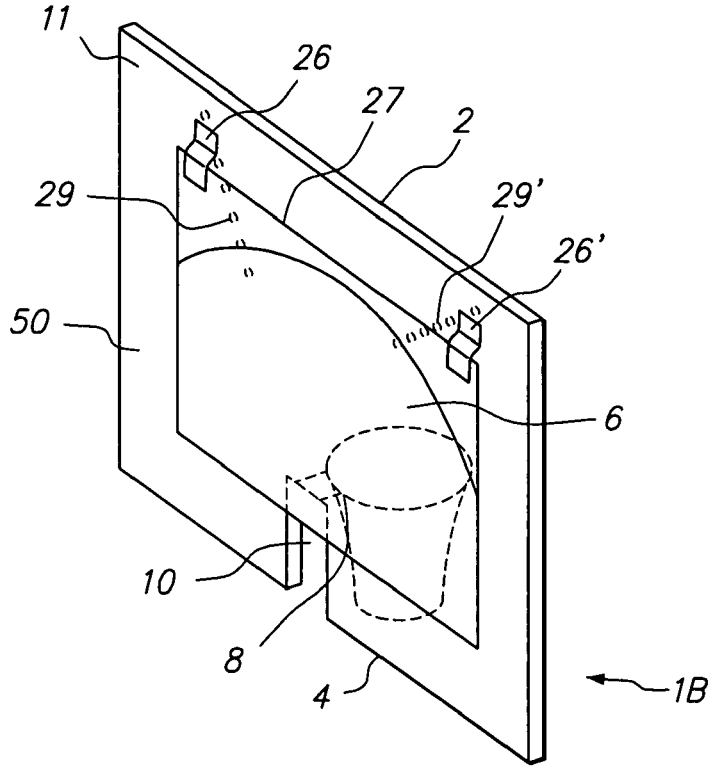
FIG. 4 is perspective back view of a removable decorative backboard signboard attached/secured to a basketball backboard according to another embodiment of the invention using a flat hook arrangement.

As illustrated in FIG. 4, in another embodiment of the invention, the top portion 11 of the back face 50 of a signboard 1B has two flat hooks 26 and 26' which extend over the back edge 27 of backboard 6. The flat hooks 26 and 26' are positioned so that the hooks secure to the backboard 6, and also allow the rectangular opening 10 on signboard 1B to anchor on to rim 8. This is accomplished by positioning the flat hooks 26 and 26' in one pair of a plurality of different hole locations arranged in a diagonal hole pattern 29 and 29', and thus accommodates any size or shape backboard, as will be illustrated in FIG. 4*a* and FIG. 4*b*. The signboard 1B can provide signage on both the front face 2 and back face 50. To display indicia on the back face 50, hooks 26 and 26' are mounted to the front face 2.

Figure 4A:
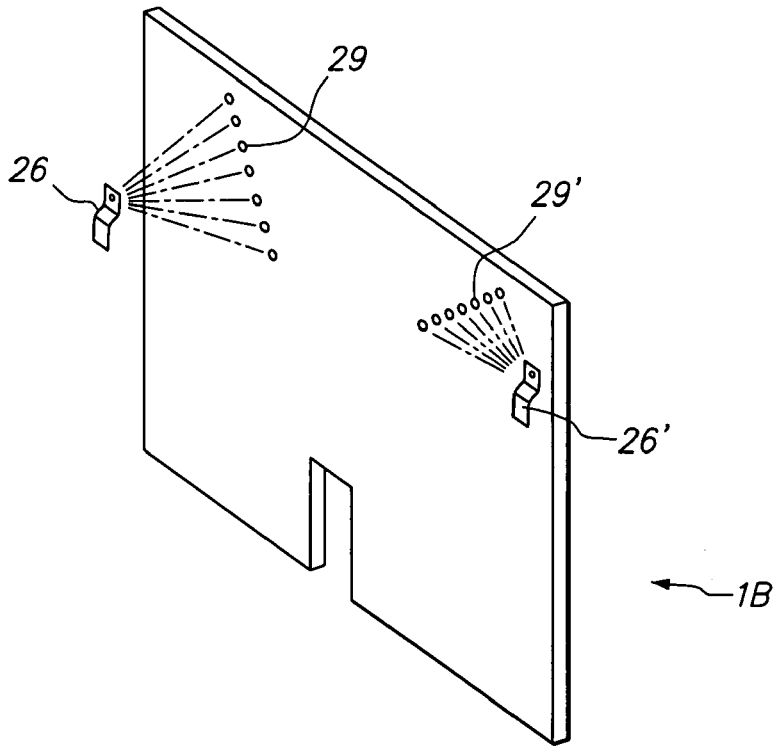
FIG. 4*a* is a back view of the removable decorative backboard signboard removed from the backboard showing the diagonal hole arrangement in FIG. 4 which allows the flat hooks to be attached in different locations on the signboard to accommodate any size or shape basketball backboard.

FIG. 4*a* illustrates the signboard 1B removed from the basketball backboard (not shown) to show diagonal hole patterns 29 and 29' more clearly. As indicated above, providing a plurality of holes arranged in hole patterns 29 and 29' enables the flat hooks 26 and 26' (shown projected to each hole with dashed lines) to be attached at different locations on signboard 1B to accommodate any size or shape basketball backboard.

Figure 4B:
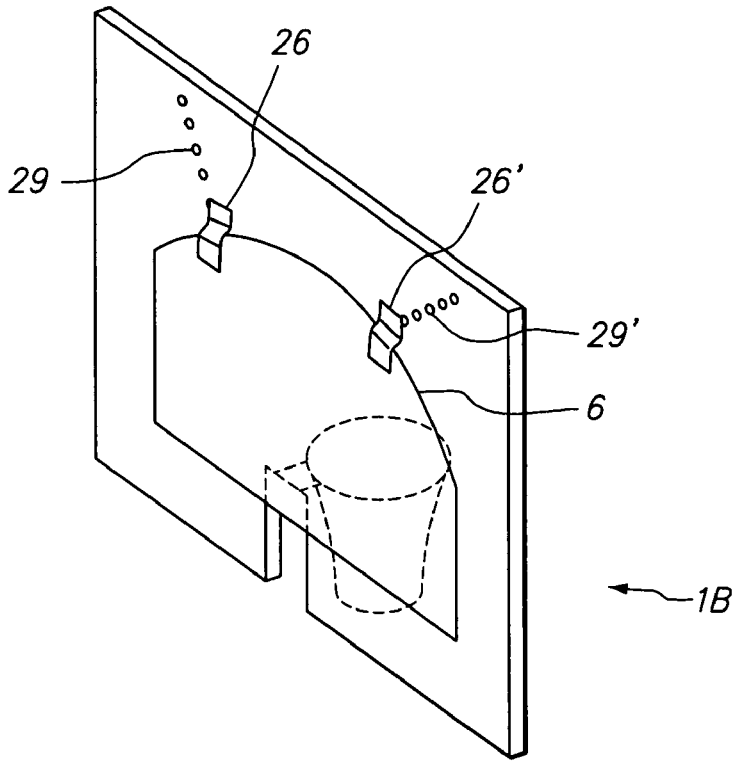
FIG. 4*b* is a perspective back view showing the flat hooks in lower positioned holes of the diagonal hole pattern shown in FIG. 4*a;*

FIG. 4*b* is similar to FIG. 4, however, this drawing shows flat hooks 26 and 26' in lower positioned holes of hole patterns 29 and 29' to accommodate a fan-shaped basketball backboard 6 or other shaped backboard requiring a lower hook attachment. Note also that hooks 26 and 26' can be rotated within holes 29 and 29', respectively, to accommodate the curved top edge of backboard 6.

Figure 4C:
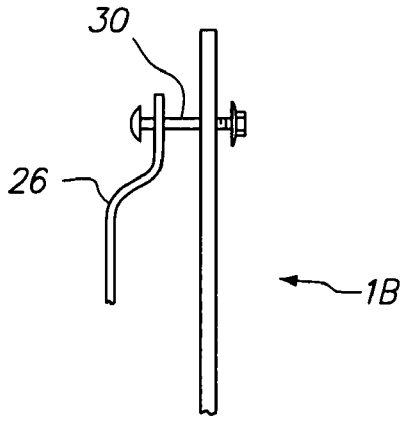
FIG. 4*c* is a side view of the removable decorative backboard signboard illustrating the attachment of the hook to the signboard.

FIG. 4*c* is a close-up of the side view of signboard 1B removed from the backboard (not shown) and illustrates flat hook 26 attached to the signboard 1B via a nut, washer and bolt combination fastening arrangement 30. Other suitable means of attaching the flat hook to the signboard could also be used. As just one of many possible examples, simply providing hook 26 with a post which is held in holes 29 by friction would suffice for some applications.

Figure 5:
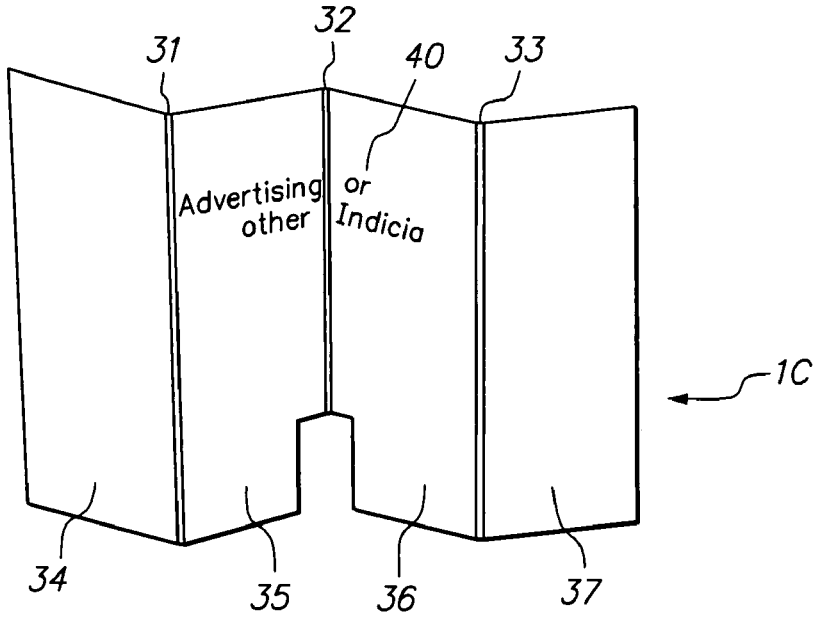
FIG. 5 is a perspective view of the removable decorative backboard signboard in a semi-folded configuration.

FIG. 5 is a perspective view of another embodiment of the invention, showing the signboard 1C being folded and maintaining the integrity of signboard 1C and the indicia 40. The material is scored or cut 31, 32 and 33 so that the folds are equally spaced and parallel to each other, thereby defining fold sections 34, 35, 36 and 37.

Figure 5A:
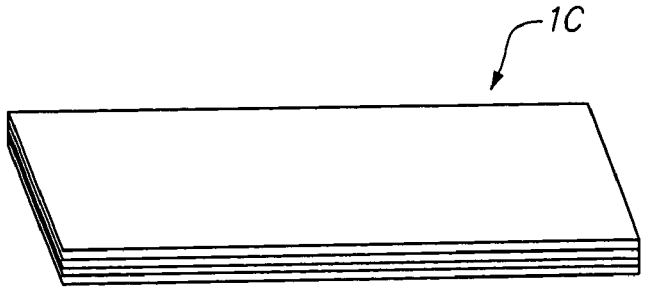
FIG. 5*a* is a perspective view of the removable decorative backboard signboard in a fully folded configuration.

FIG. 5*a* illustrates the signboard 1C in a fully folded position after use. Since the substantially rigid, weather resistant material will likely have springiness in the folds, the signboard may be wrapped with rope, elastic or BUNGY cord material or other suitable means such as a detachably attachable sleeve or container (not shown).

Figure 6:
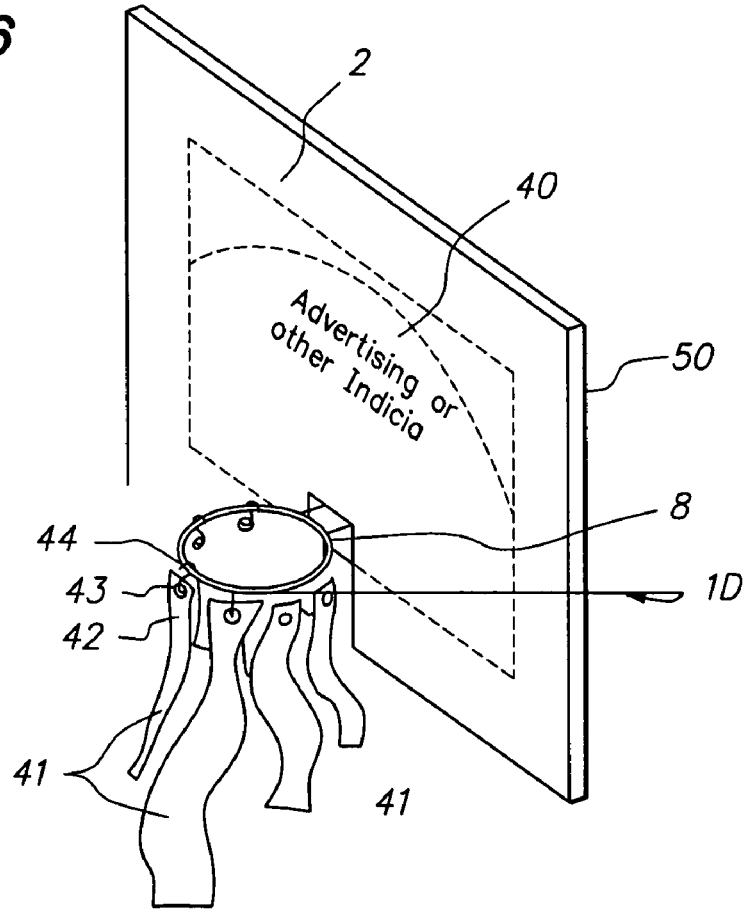
FIG. 6 is a perspective view of the removable decorative backboard signboard with complementary decorative matter attached to the backboard rim.

FIG. 6 is a perspective view of another embodiment of the invention showing a signboard ID with complementary decorative matter 41 adapted for attachment to rim 8. Complementary decorative matter 41 includes any indicia on rim 8 that complements the indicia 40 displayed on signboard 1D. Examples of complementary decorative matter 41 adapted for attachment to rim 8 include, but are not limited to, white cloth or cotton to mimic beard material to complement a Santa Clause signboard, a hanging goblin or ghost figure to complement a Halloween signboard, or streams of cloth or other flexible material to match the color scheme of a favorite sports team mascot or country flag signboard. To apply the complementary matter 41 to rim 8, in this particular embodiment, the top 42 of the fabric or other suitable complementary matter material 41 would utilize one or more grommets or other suitable device 43 providing one or more holes 43 through which an s-hook, string, twine, or other suitable means of attachment 44 may be used to attach the complementary decorative matter 41 from the grommet hole 43 to rim 8. Those skilled in the art will recognize that other attachment methods (e.g., winding around rim 8, resting within rim 8, tying to rim 8, attachment to a basketball net suspended from rim 8, etc.) are possible, and are considered to be within the scope of the invention.

Figure 6A:
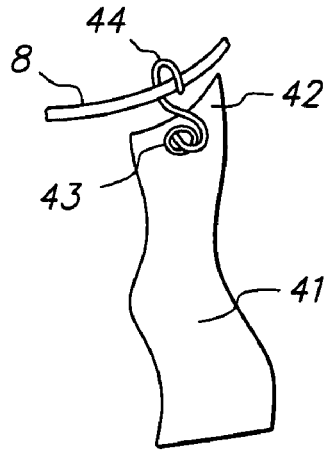
FIG. 6*a* is a close-up view illustrating the application of the complementary decorative matter to a portion of the backboard rim in FIG. 6.

FIG. 6*a* is a close-up view illustrating the application of the complementary decorative matter 41 to rim 8. As indicated above, this embodiment provides just one example of a means of attaching complementary decorative matter to rim 8, and any means of attachment, now known or later developed, is considered to be within the scope of the invention.

Figure 7A:
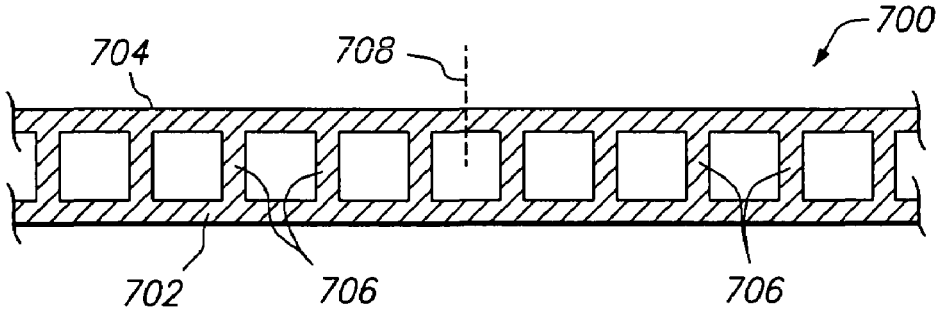
FIG. 7*a* is a cross-sectional view of a material suitable for use in the signboard of FIG. 1.

FIG. 7*a* is a cross-sectional view of a material 700 that the inventors have determined to be particularly well suited for constructing some embodiments (particularly folding signboard 1C) of the invention. Material 700 is a corrugated plastic material that includes a front sheet 702 and a rear sheet 704, joined by a plurality of cross supports 706 to provide rigidity. Material similar to material 700 is commercially available from Coroplast, Inc. of Dallas Tex.

Figure 7B:
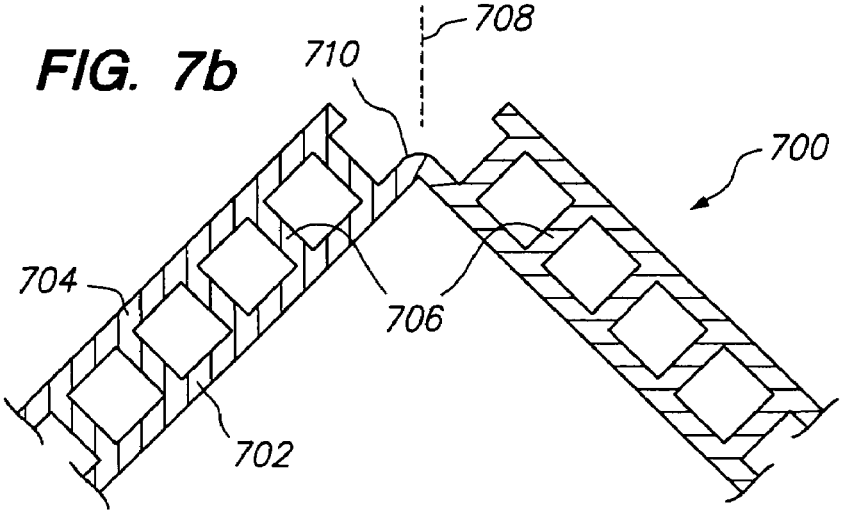
FIG. 7*b* shows the material of FIG. 7*a* in a partially folded configuration.

FIG. 7*b* shows how material 700 can be folded by making a cut, parallel to cross supports 706, through one of front sheet 702 and rear sheet 704. For example, cutting rear sheet 704 at dashed line 708 allows material 700 to be folded as shown in FIG. 7*b*. Note that front sheet 702 is substantially rigid, yet pliable enough to allow a bend 710 to be formed therein.

Figure 7C:
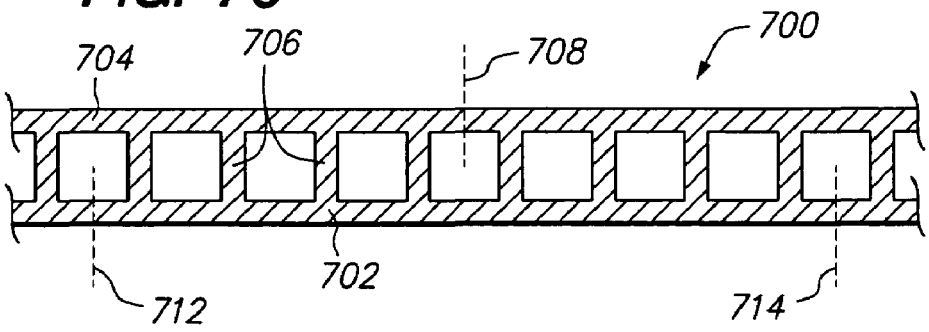
FIG. 7*c* shows the material of FIG. 7*a* with a plurality of cuts formed therein.

FIG. 7*c* shows how material 700 can be cut several times to facilitate fan folding of material 700, as shown for example in the embodiment FIG. 5*a*. For example, cutting rear surface 704 at line 708, and cutting front surface 702 at lines 712 and 714 allows material 700 to be fan folded in four sections. After making cuts 708, 712, and 714, the section to the left of line 712 is folded upward, the sections between lines 712 and 708 and between 708 and 714 are folded downward, and the section to the right of line 714 is folded upward.

It should be noted that FIG. 7*c* is not drawn to scale. In particular, the thickness of material 700 for typical applications would be on the order of an inch or less, whereas the spacings between lines 708, 712, and 714 would be on the order of a foot or more.

The invention has been described herein with reference to particular embodiments, and various specific details are provided to facilitate a clear understanding of the invention. It should be understood, however, that many of the described features may be substituted, altered or omitted without departing from the scope of the invention. Further various embodiments of the invention may provide some, but not necessarily all of the above described advantages. For example, if the signboard is intended for indoor use (e.g., gymnasium), then the signboard need not be manufactured of weather resistant material. Accordingly, no single aspect or advantage of the invention is considered to be an essential element of the invention, and should not, therefore, be considered a limitation, except as explicitly set forth in the claims.

We claim:

1. A sign comprising:

a basketball backboard;

a rim mounted to said basketball backboard;

a substantially rigid sheet of material having indicia on a front surface thereof, and including a lower edge defining an opening substantially centered therein for engaging said rim, said lower edge being determined by the orientation of said indicia; and an attachment device adapted to secure said sheet to said backboard.

2. A sign according to claim 1, wherein said attachment device includes at least one elastic cord.

3. A sign according to claim 2, wherein said attachment device further includes a hook attached to and end of said elastic cord.

4. A sign according to claim 2, wherein said attachment device further includes a ring attached to a rear surface of said sheet of material.

5. A sign according to claim 2, wherein at least one end of said elastic cord is fixed to said sheet of material.

6. A sign according to claim 1, wherein said attachment device includes at least one strap.

7. A sign according to claim 6, wherein said sheet material defines at least two slots to facilitate the passage of said strap.

8. A sign according to claim 7, wherein said sheet material defines at least four slots to facilitate the passage of said strap.

9. A sign according to claim 8, wherein said attachment device includes no more than one strap.

10. A sign according to claim 1, wherein said opening comprises a rectangular notch.

11. A sign according to claim 1, wherein said attachment device includes at least one catch mounted to a rear surface of said sheet of material to engage an edge of said backboard.

12. A sign according to claim 11, wherein said catch includes a flat hook.

13. A sign according to claim 11, wherein said sheet of material includes a plurality of predefined mounting positions each adapted to detachable engage said catch.

14. A sign according to claim 13, wherein said predefined mounting positions include apertures at least partially through said sheet of material.

15. A sign according to claim 13, wherein said predefined mounting positions are ranged obliquely on said sheet of material.

16. A sign according to claim 1, wherein said sheet of material further includes indicia on a back surface thereof.

17. A sign according to claim 16, wherein said attachment device is reversible, such that either said front surface or said back surface of said sheet of material can be selectively displayed.

18. A sign according to claim 1, wherein said sheet of material is substantially larger than a standard basketball backboard.

19. A sign according to claim 1, wherein said sheet of material has a shape that is different than the shape of a standard basketball backboard.

20. A sign according to claim 1, further including decorative matter complementary to said indicia attached to said rim.

21. A sign according to claim 1, wherein said sheet of material has at least one cat therein to facilitate folding of said sheet material, said cut passing through one but not both of said front surface and a back surface of said sheet material.

22. A sign according to claim 1, wherein:

said sheet of material has a rear surface and a plurality of cross supports joining said front surface and said rear surface; and one of said front surface and said rear surface defines a cut therethrough extending between an adjacent pair of said cross supports to facilitate at least one fold being formed in the other of said front surface and said rear surface extending between said adjacent pair of said cross supports.

23. A sign according to claim 1, wherein said sheet of material is foldable plastic.

24. A method of displaying signage on a mounted basketball backboard having a rim attached thereto, said method comprising:

providing a substantially rigid sheet of material having indicia on a front surface thereof, said sheet of material including a lower edge defining an opening therein;

positioning said sheet of material on said mounted backboard such that said opening engages a portion of said rim; and securing said sheet of material to said backboard.

25. A method according to claim 24, further comprising attaching decorative matter to said rim, said decorative matter being complementary to said indicia.

26. A sign comprising:

a basketball backboard;

a rim attached to said basketball backboard;

a substantially rigid sheet of material having indicia on a front surface thereof, and including a lower edge defining an opening therein for engaging said rim; and means for securing said sheet to said backboard.

27. A sign comprising:

a basketball backboard;

a rim attached to said basketball backboard;

a substantially rigid sheet of material having indicia on a front surface thereof, and including a lower edge defining an opening therein for engaging said rim; and an attachment device adapted to secure said sheet to said backboard, said attachment device including at least one cord.

28. A sign according to claim 27, wherein said cord is an elastic cord.

29. A sign according to claim 28, wherein said attachment device further includes a hook attached to and end of said elastic cord.

30. A sign according to claim 28, wherein said attachment device further includes a ring attached to a rear surface of said sheet of material.

31. A sign according to claim 28, wherein at least one end of said elastic cord is fixed to said sheet of material.

32. A sign comprising:

a basketball backboard;

a rim attached to said basketball backboard;

a substantially rigid sheet of material having indicia on a front surface thereof, and including a lower edge defining an opening therein for engaging said rim; and an attachment device adapted to secure said sheet to said backboard, said attachment device including at least one strap.

33. A sign according to claim 32, wherein said sheet material defines at least two slots to facilitate the passage of said strap.

34. A sign according to claim 33, wherein said sheet material defines at least four slots to facilitate the passage of said strap.

35. A sign according to claim 34, wherein said attachment device includes no more than one strap.

36. A sign comprising:

a basketball backboard;

a rim attached to said basketball backboard;

a substantially rigid sheet of material having indicia on a front surface thereof, and including a lower edge defining an opening therein for engaging said rim; and an attachment device adapted to secure said sheet to said backboard, said attachment device including at least one catch mounted to a rear surface of said sheet of material to engage an edge of said backboard.

37. A sign according to claim 36, wherein said catch includes a flat hook.

* * * * *